United States Patent [19]

Nelson

[11] 4,099,561

[45] Jul. 11, 1978

[54] OVERSHOT CUTTER WITH FLEXIBLE RELEASE CAGE

[75] Inventor: Paul M. Nelson, Houston, Tex.

[73] Assignee: Wilson Industries, Inc., Houston, Tex.

[21] Appl. No.: 795,949

[22] Filed: May 11, 1977

[51] Int. Cl.[2] ..... E21B 33/03

[52] U.S. Cl. ..... 166/55.1; 166/55.6; 166/217; 294/86.34

[58] Field of Search ..... 166/55.6, 55.1, 217, 166/216, 99; 294/86.18, 86.34

[56] References Cited

U.S. PATENT DOCUMENTS

| | | | |
|---|---|---|---|
| 2,325,104 | 7/1943 | Brown et al. | 166/55.6 |
| 3,006,412 | 10/1961 | Brown | 166/55.6 |
| 3,031,015 | 4/1962 | De Cordova | 166/55.6 |
| 3,056,453 | 10/1962 | Foreman, Jr. | 166/55.6 |
| 3,874,447 | 4/1975 | McGowen, Jr. | 294/86.18 |

*Primary Examiner*—James A. Leppink
*Attorney, Agent, or Firm*—Arnold, White & Durkee

[57] ABSTRACT

An overshot cutter includes concentric inner and outer members, the latter having a radially flexible portion thereon. A gripper for gripping a portion of a drill string is mounted on the flexible portion. The members have inclined surfaces which, when engaged, prevent radial flexing of the inner member as the overshot cutter is lowered over the drill string. When the gripper encounters an obstacle the outer member moves relative to the inner member to axially space apart the surfaces. The inner member and the gripper thereon thereby move radially outwardly to clear the obstruction. In a first embodiment, a spring imposes a biasing force on the inner member to maintain engagement between the surfaces. When an obstruction is encountered, continued downstring advancement of the outer with respect to the inner member disengages the surfaces to define the radial clearance and for shorten the spring to store energy to re-establish contact of the surfaces after the obstruction is passed. In a second embodiment a dowel on the outer member engages a groove on the inner member so that rotation of the outer relative to the inner member disposes the dowel in the groove to space the surfaces apart and define the radial clearance. In each embodiment, the surfaces brace the gripper into engagement with a distended portion of the drill string when it is desired to extend cutting elements provided.

7 Claims, 17 Drawing Figures

OVERSHOT CUTTER WITH FLEXIBLE RELEASE CAGE

BACKGROUND OF THE INVENTION

1. Field of the Invention

This invention relates to pipe-cutting tools for cutting pipe within a well bore, and more particularly, to an exterior, or overshot, pipe cutter.

2. Description of the Prior Art

During operations associated with the extraction of hydrocarbons from producing formations it sometimes occurs that a portion of the drill string that has been axially advanced to generate the well bore may become engaged within the bore. When this occurs, retraction or manipulation of the string is prohibited or encumbered. Since the piping comprising the drill string is relatively expensive, it is desirable and economically advantageous to recover as much of the string as possible from the bore.

For this purpose tools known in the art as outside, or overshot, pipe cutters are utilized. Such overshot cutters carry radially inwardly extendable cutting elements. Upon actuation, the cutting elements engage the exterior surface of the drill string to be severed (commonly known as the fish), and sever the string from the outside thereof. Upon a completion of the cut, the severed portion of the fish rests upon the cutting elements, which thereby provide supports for carrying it to the surface with retraction of the cutter.

Due to the close radial clearances between the exterior surface of the drill string and the interior surface of the bore, it is necessary that all operative portions of the overshot cutter, including the cutting elements and the actuating mechanism therefor, be initially housed within a relatively thin-walled, annular structure. The structure is lowered into the annular space between the exterior of the drill string and the interior of the bore until the cutting elements are in proximity to the point at which it is desired to sever the fish. Usually the actuating mechanism comprises inner and outer concentric, relatively movable, members which are initially joined together by a shear pin of easily severable material. This joining of the concentric inner and outer members prevents premature actuation and extension of the cutting elements and yet permits expeditious actuation and extention thereof when it is desired to do so. However, some form of gripping element is usually provided to enable the inner member to remain stationary with respect to the outer member to permit severance of the shear pin.

The sections of the drill string engaged within the well usually comprise elongated axial portions of pipe joined to the next-axially adjacent portion at each end thereof by a radially distended collar. These periodic radial distensions of the collars between adjacent drill pipe sections obstruct the dimension of the annulus between the exterior of the string and interior of the bore and require that some provision be made in the overshot cutter to permit the gripping elements to pass in an axially downstring direction over the distended collars.

It may, therefore, be appreciated that it is necessary for an overshot cutter to exhibit an effective annular dimension sufficient to permit it to pass substantially unhampered over the radially distended collar portions of the drill string as the overshot is moved axially downstring. Yet, at the same time, it is necessary that the cutter provide a radially inwardly disposed gripping arrangement such that proper bracing may be effected between the concentric inner and outer members to permit severance of the shear pin and extension of the cutter elements.

A common method of meeting both these goals is to provide resilient spring steel members cantilevered about the inner surface of the overshot cutter. These members serve as gripping elements able to bend or flex radially outwardly as the overshot moves in the downstring direction. Such spring steel members can, therefore pass substantially unhampered over the radially distended collars as the cutter is moved in a downstring direction. However, once axially cleared of the collars, the spring steel gripping members are resiliently urged back into contact with the smaller diameter of the elongated pipe sections and maintain contact therewith. Thus, when it is desired to sever the shear pin and extend the cutting elements, an axially upstring movement imparted to the overshot brings the gripping elements in contact with the underside of the collars. The gripping contact therebetween provides suitable bracing to permit severing of the shear pin. U.S. Pat. Nos. 1,458,118 (Plante), 1,709,141 (McCullough), 1,855,338 (Church), and 1,936,643 (Reed), all disclose outside pipe cutting apparatus embodying resilient, cantilevered gripping elements operable as described.

One disadvantage of the cutters using the structure of the last-mentioned patents is that once the spring steel gripping elements have passed over the radial obstruction in the axial downstring direction, the only way to retract the overshot cutter before making the cut is to apply sufficient axially upward force to sever both the gripping elements and the cutting elements. This is disadvantageous.

It has also been the practice in the prior art to utilize an overshot cutter which provides constant annular dimension throughout its entire length. Such structures do not have radially inwardly extending resilient gripping elements, or the like. Thus, the problem of movement over the distended collars is not presented. Instead, complicated structural elements are provided which serve as radially inwardly extendable gripping elements once the cutter is in position. Cutters of this type thus include a two-step operative mode. The first step, when the cutting elements are in proximity to the portion of the string to be severed, requires extension of the gripping elements radially inwardly to engage the fish to be severed. The second step of the operation is the utilization of the gripping elements to provide the radially inwardly extension of the cutting elements to contact the pipe to be cut. Exemplary of such prior art devices are U.S. Pat. Nos. 1,454,819 (Jones et al.), 1,944,594 (Church et al.), 2,160,691 (Edwards), 3,031,015 (DeCordova), and 3,056,453 (Foreman, Jr.).

Such cutters have the disadvantage of being overly complicated from the structural standpoint, and, for this reason, are disadvantageous.

It is also known in other areas of oil field technology, such as in latch assemblies for the gripping of a fish from the interior thereof, to provide flexible sleeves which are locked and prevented from radial movement by a radially inwardly disposed locking member. Upon axial displacement of the locking member, sufficient radial clearance is provided to permit radial movement of the sleeve. For example, U.S. Pat. Nos. 3,638,988 (Brown), 3,874,447 and 3,874,448 (both to McGowan, Jr.) exhibit radially movable members initially prevented from radial displacement by the provision of a locking element. Upon axial movement of the locking element sufficient radial clearance is provided to permit radial displacement of the movable members.

In the context of overshot cutting elements, it is desirable to provide an overshot cutter having radially inwardly extending gripping elements which engage a portion of the pipe to be severed to thereby brace an inner member of the overshot with respect to an outer concentric member thereof to actuate and to extend the cutting elements into engagement with the pipe to be severed. It is also advantageous to provide an overshot cutter able to permit radial displacement of the gripping elements as those gripping elements become obstructed during downstring movement of the overshot into the well bore. For this purpose it is advantageous to provide an overshot cutter having an inner member including a flexible portion with inclined surfaces adopted to be received and engaged by correspondingly inclined surfaces on the outer member so that abutment of the surfaces prevents radial movement of the flexible inner member. However, it is advantageous that when the inclined surfaces are disengaged and spaced axially apart, a radial clearance is defined sufficient to permit the inner member and the gripping elements thereon to flex radially outward to permit the gripping elements to clear the radial distensions on the exterior surface of the drill string.

It is of even further advantage to provide an overshot cutter wherein one embodiment thereof is arranged so that a spring or other suitable biasing element maintains the inclined surfaces in engagement while the overshot is moving unhampered and unobstructed in a downstring direction. Yet, when the inner portion and gripping elements become obstructed by radially distended portions of the drill string, continued axial displacement of the outer member spaces the inclined surfaces apart against the bias of the spring to provide sufficient radial clearance to permit the inner member and the gripping elements to move radially outwardly and pass the obstruction. It is also of advantage to provide a second embodiment of the overshot cutter such that rotation of the outer member places a radially inwardly extending dowel thereon into a groove provided on the concentric inner member. Engagement of the dowel with the groove axially spaces apart the inclined surfaces and provides sufficient radial clearance to permit the gripping elements to move radially outwardly from the obstruction.

SUMMARY OF THE INVENTION

An overshot cutter apparatus embodying the teachings of this invention disposes concentrically arranged inner and outer members, the latter provided with radially inwardly pivotable cutting elements and the former being provided with surfaces sized to engage the cutting elements and impel them radially inwardly when the outer member is moved with respect to the inner member.

The inner member is also provided with radially inwardly extending gripping elements which engage distended portions on the exterior of the drill string to be severed to hold the inner member stationary with respect to the outer member when it is desired to extend the cutting elements.

In order to permit the gripping elements to pass over the distensions on the drill string as the cutter is moved in an axially downstring direction, the portion of the inner member on which the gripping elements are mounted is flexible and has a first abutment surface thereon. The concentric outer member is provided with a corresponding abutment surface, the abutment surfaces being normally engaged to prevent radially outward flexing of the inner member as the overshot moves in the downstring direction. However, when the gripping elements are obstructed by the, as by pipe joints between adjacent drill pipe sections, axial movement of the outer member relative to the inner member disengages and axially spaces apart the abutment surfaces to define a radial clearance between the inner and outer members. The clearance so defined is sufficient to permit radially outward flexing of the inner member to permit the gripping elements to move radially outwardly and clear the obstruction.

In one embodiment of the invention, a spring biasing element is provided to maintain the normal engagement between the abutment surfaces. However, as the outer member moves axially with respect to the inner member to space the abutment surfaces, the spring is foreshortened to store energy to reestablish the abutment once the gripping elements are axially cleared of the obstruction.

In a second embodiment of the invention, a radially inwardly extending dowel is provided on the outer member and a groove is provided on the inner member such that rotation of the outer member places the dowel within the groove to thereby maintain the abutment surfaces axially apart to permit radial movement of the flexible portion and the gripping elements thereon.

Once proximal to the portion of the string to be severed, the gripping elements are braced by the abutment surfaces into engaged contact with the drill string to maintain the inner member stationary as the outer member is moved relative thereto and the cutting elements are extended.

A sufficient axially upward force imposed upon the outer member permits the gripping elements to move radially outwardly over the obstructions and to permit the overshot to be withdrawn from cutting position.

BRIEF DESCRIPTION OF THE DRAWINGS

The invention will be more fully understood from the following detailed description thereof, taken in connection with accompanying drawings in which.

DESCRIPTION OF THE PREFERRED EMBODIMENT

Figure 1A:
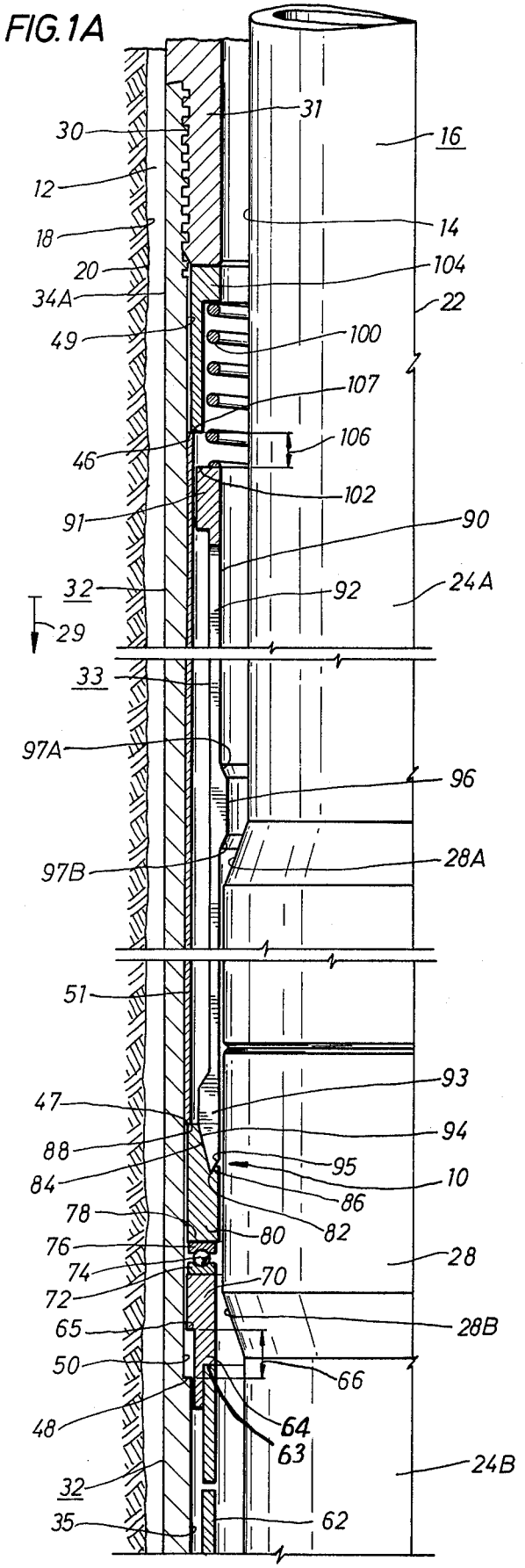
FIGS. 1A and 1B are elevational views, entirely in section, of a first embodiment of an overshot cutter illustrating the teachings of this invention.

Throughout the following description similar reference numerals refer to similar elements in all figures of the drawings.

Figure 1B:
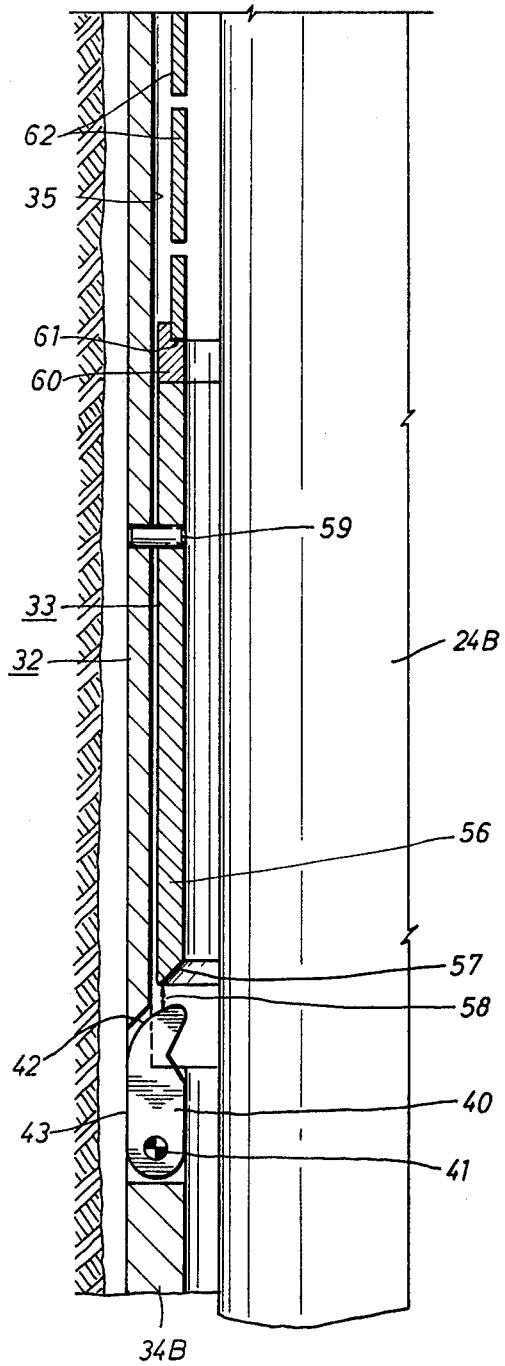

Referring first to FIGS. 1A & 1B, an elevational view, entirely in section, a first embodiment of an overshot cutter apparatus 10 embodying the teachings of this invention is shown. The overshot cutter 10 is adapted to be inserted within an annular region 12 defined between the radially exterior surface 14 of a drill string 16 and the interior surface 18 of the well bore 20. The bore 20 may be provided with a casing in a manner known to those skilled in the art. The drill string 16 has a central axis 22 extending therethrough. The axis of the overshot cutter tool 10 is substantially coincident therewith. The drill string 16 usually includes a plurality of enlongated pipe portions disposed axially adjacent to each other, two of which, 24A and 24B, are illustrated in FIG. 1. The pipe portions 24A and 24B are usually threadedly connected at a collar portion 28. As may be seen in reference to FIG. 1A, the collar 28 is radially enlarged, or distended, with respect to the radius of the pipe portions 24. The radial enlargement partially obstructs annular region 12 in the vicinity of the collar 28. The collar has axially upstring and downstring surfaces, 28A and 28B, respectively, thereon.

If, for any number of reasons, it becomes necessary to recover an upper length of the drill string from a lower length thereof, the overshot cutter 10 is lowered into the bore 20 in the annular region 12 until the cutter 10 is axially adjacent to that point on the drill string above which it is desired to recover the pipe extending to the surface. In order to effectuate this intent it is necessary for the overshot cutter 10 to be able to pass within the annulus 12 over both the axially upstring surfaces 28A of the radially distended collars 28 and the reduced-diameter, elongated portions 24 of the drill pipe as the overshot is lowered in the downstring direction (indicated by reference arrow 29). Yet, at the same time, the overshot 10 must provide a mechanism whereby the overshot may be braced against the axially downstring surfaces 28A of the collars 28 to permit extension of cutting elements provided therein. The overshot cutter 10 embodying the teachings of this invention meets these above requirements.

The overshot cutter 10 shown in FIG. 1 is threadedly engaged, as at 30, with a lower sub 31. This lower sub 31, although part of the tool 10, is the connector by which the tool 10 is attached to a running string. The cutter 10 includes an outer barrel member 32 concentrically surrounding an inner member, generally indicated at 33. The barrel 32 has a relatively thin-walled upper portion 34A axially extending from the lower sub 31 to a relatively thicker-walled lower portion 34B (FIG. 1B). The difference between the dimensions of the portions 34A and 34B defines a hollow, or annular volume, 35 between the lower end of the lower sub 31 and the thicker portion 34B. Within this hollow 35 the elements comprising the inner member 33 are disposed. It is noted that the radial dimension of both the thin-walled portion 34A of the outer barrel 32 and the elements comprising inner member 33 disposed radially inwardly thereof is substantially equal to the radial dimension of the thicker portion 34A of the outer member 32. As will be made clearer herein, there is provided a gripping element which extends radially inwardly of the basic radial dimension.

Pivotally mounted to the thicker portion 34B of the outer barrel 32 for radially inwardly extension relative thereto is at least one, but preferably a plurality of cutting elements 40. The pivotal connection may be effected by pins 41 received within the thicker portion 34B. The cutting elements 40 each have a sloped upper surface 42 thereon. The cutting elements 40 are further provided with carrier surfaces 43. In FIG. 1, the cutting elements 40 are in the retracted state, and friction between the cutting elements 40 and the pins 41 being sufficient to hold the cutting elements 40 in the illustrated condition.

As seen in FIG. 1A, the interior of the thin-walled portion 34A of the barrel 32 is provided with radially inwardly extending shoulders 46, 47 and 48. The shoulder 46 is adjacent to the lower sub 31 and faces axially upwardly. The shoulder 46 cooperates with the end of the lower sub 31 to define a hollow space 49 in the upstring end of the cutter 10. The shoulders 47 and 48 axially face each other to define a second hollowed space 50 substantially axially centrally of the cutter 10. The shoulders 46 and 47 may be conveniently defined by securing an axially extending sleeve or liner 51 to the interior thin-walled portion 34A of the outer barrel 32.

The inner member 33 is disposed within the hollow or annular volume 35 between the end of the lower sub 31 and the thicker portion 34B. The inner member 33 includes (proceeding axially from the lower to the upper ends thereof), a feed ring or sleeve 56 (FIG. 1B). The feed ring 56 terminates in a sloped surface 57 corresponding to the sloped surface 42 on the cutting element 40. In the unactuated position shown in FIG. 1, the feed ring 56 is spaced a predetermined distance 58 above the cutting element 40. The surfaces 42 and 57 are held in place by a radially extending shear pin 59. The pin 59 is fabricated of an easily sheared material, such as brass, as appreciated by those with skill in the art.

Axially above the feed ring 56 is a bottom spring centralizer 60 (FIG. 1B), with a notch 61 provided therein. The centralizer 60 receives the lower end of a power spring 62, the purpose of which is to force the cutting elements 40 inwardly (FIGS. 1A, 1B). The upper end of the spring 62 is received within a notch 63 on an upper spring centralizer 64. The spring 62 is biased to axially spread or open the gaps between the turns thereof.

The upper spring centralizer 64 has a radially outwardly extending notch 65 cut therein. The notch 65 is disposed within the second recess 50 provided between the shoulders 47 and 48 within the barrel 32. In the unactuated position shown in FIG. 1, an axial clearance 66 is provided between the shoulder 48 in the barrel 32 and the notch 65 on the upper spring centralizer 64. As seen from FIG. 1, the distance 65 (FIG. 1A) is greater than the axial distance 58 (FIG. 1B) between the lower end 57 of the sleeve 56 and the surface 42 of the cutting elements 40.

The axially upper surface 70 of the upper spring centralizer 64 receives a lower bearing race 72 for a bearing member 74. An upper bearing race 76 is received on the axially lower surface 78 of a flexible cage seat member 80. As is made more clear herein, the bearing member 74 permits free rotation of the elements of the inner member 33 axially below the bearing member 74 with respect to those elements of the inner member 33 axially above the bearing member 74.

The cage seat member 80 has a notch 82 cut into the radially inner surface thereof to define an extended inclined abutment surface 84 and a shorter inclined locking surface 86. The radially outer tip 88 of the cage seat member 80 fits securely against the shoulder 47 of the liner 51.

Figure 4C:
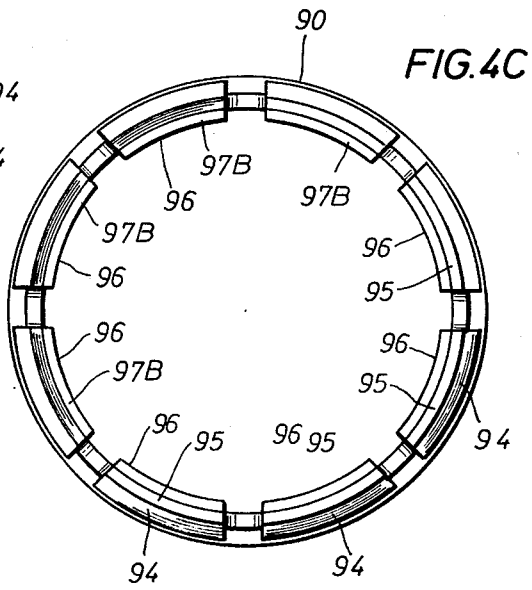
FIGS. 4A through 4C are isolated elevational and sectional views of a flexible inner member used in connection with the embodiment of the invention shown in FIGS. 1 through 3.
Figure 4A:
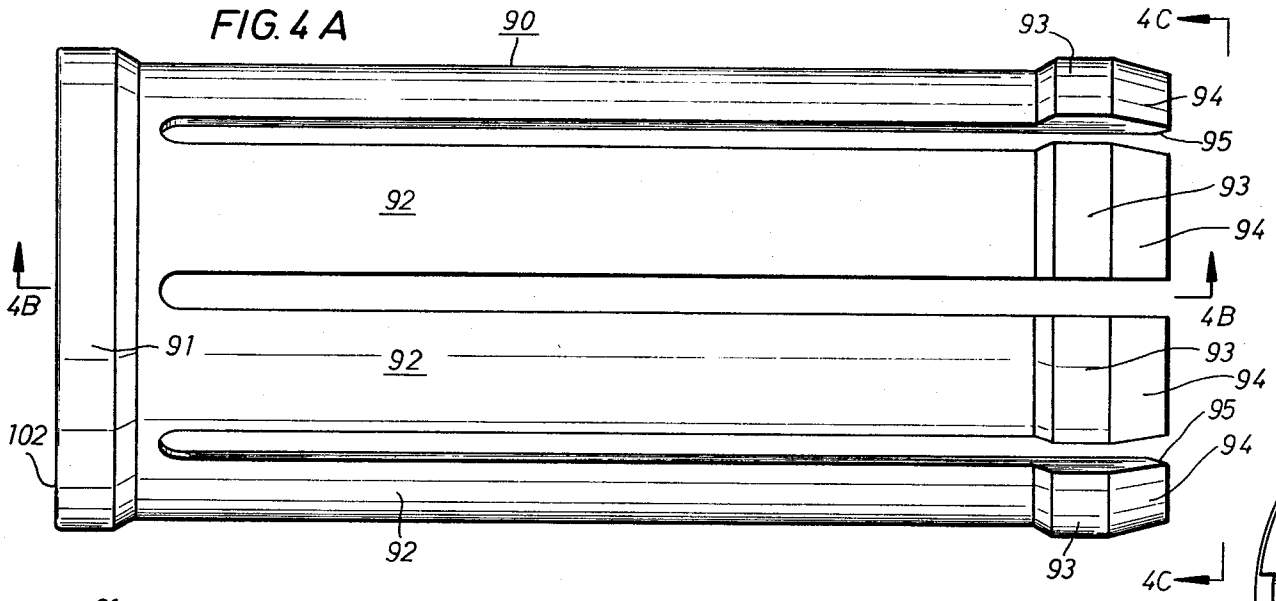
Figure 4B:
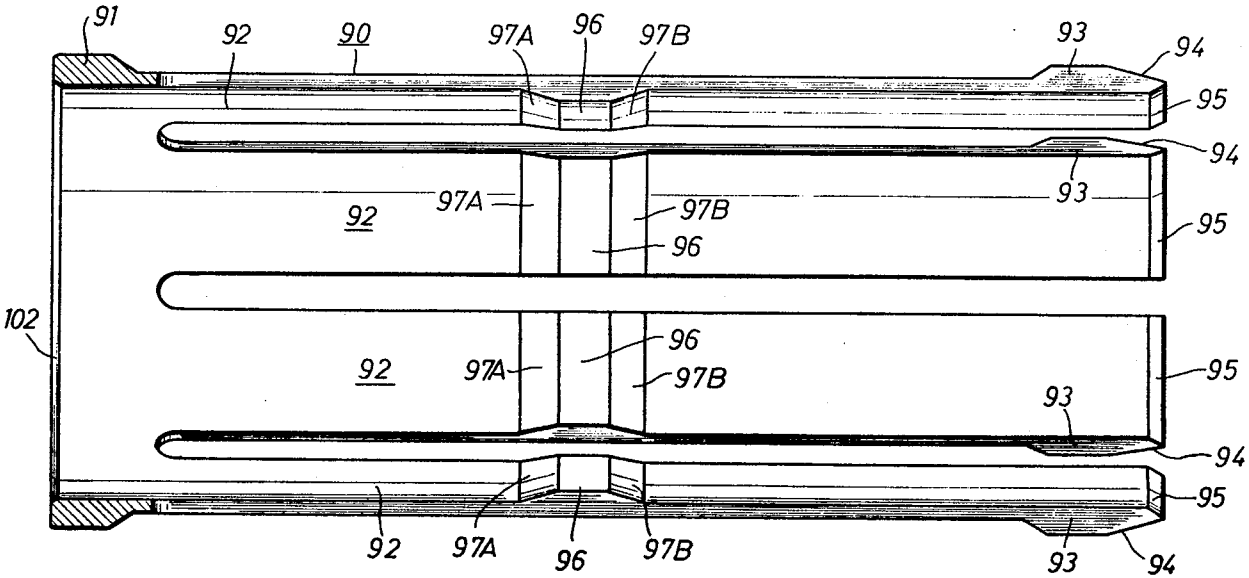

Next-axially adjacent to the cage seat member 80 is a flexible cage 90. As seen more clearly in the isolated views in FIG. 4, the cage 90 is a substantially cylindrical member having an annular collar 91 from which axially extend a plurality of fingers 92. The fingers 92 each terminate in a tip 93, the tip 93 being defined by an elongated inclined surface 94 and a shorter surface 95. The surfaces 94 and 95 are respectively sized to correspond to the surfaces 84 and 86 which define the notch 82 cut into the cage seat member 80.

A plurality of gripping elements 96 extend radially inwardly beyond the radial dimension of the cutter (FIG. 1A) to define means for bracing the inner member 33 against the drill pipe 24 (and more particularly, the collar 26) to actuate the cutting elements 40. The gripping elements 96 include axially upper and lower surfaces 97A and 97B, respectively. The incline of surfaces 97A and 97B correspond to the inclination of the surfaces on the 28A and 28B provided on the collars 28. It may readily be appreciated from FIG. 1A that the gripping element 96 may become obstructed by the radially outwardly extending collars 28 so that continued downward advancement of the overshot cutter 10 is hampered. A cutter 10 embodying the teachings of this invention mounts the gripping elements 96 on the flexible portion of the inner member 33 to permit radial movement of the gripping elements 96 from a first, inner, position (in which the gripping elements 96 are engaged and obstructed by the distended collars 28 of the drill pipe to obstruct axial movement of the cutter 10 with respect thereto) to a second, radially outer, position in which the gripping elements 96 are axially movable with respect to the drill pipe.

And, as will be discussed more fully herein, with the abutment between inclined surfaces 84 and 94 intact, the gripping elements 96 are, in effect, locked or prevented from radially outward movement. Thus, it is seen that the gripping elements 96 mounted in the flexible cage 90 are radially movable from a first, inner position in which the gripping element is engageable by the pipe joint to obstruct downhole movement to a second, outer position in which the gripping elements can pass radially over the distended pipe joints.

Normally biasing the surfaces 82 and 94 into abutting contact is a spring bias element 100. The spring 100 is seated against the upper lip 102 of the collar portion 91 of the cage 90 and a spring retainer element 104. The retainer 104 is received within the upper recess 49 (FIG. 1A) and abuts against the lower sub 31 and the shoulder 46 of the barrel 32. As can be seen from FIG. 1A, a predetermined clearance 106 is provided between the axially lower surface of the spring retainer 104 and the upper lip 102 of the collar 91. As is made clearer herein, the clearance 106 permits sufficient axial travel of the cage 90 to occur so as to separate the normally abutting or engaged surfaces 84 and 94. The lower end 107 of the spring retainer 104 acts as a stop to prevent the surfaces 84 and 94 from axially displacing further than the predetermined distance 106 so that the abutment surfaces 84 and 94 may be unseated and reseated expeditiously.

It is understood that as the cutter 10 is lowered into the annular region 12 its elements normally occupy the assembled relationship described in connection with FIG. 1. That is, due to the action of the spring 100, the surfaces 84 and 94 are abutted to, in effect, lock the gripping elements 96 in the first inner position. The cutting elements 40 remain in the unactuated state. However, as the overshot 10 is moved downhole, the gripping elements 96 may become obstructed by engagement with the collars 28. More specifically, the surfaces 97B (on the gripping element 96) and the surface 28A (on the collar 28) become engaged to obstruct further downhole movement. With the surfaces 84 and 94 in abutting contact, radial flexure of the gripping elements 96 from the inner to the outer position is prevented.

Figure 2A:
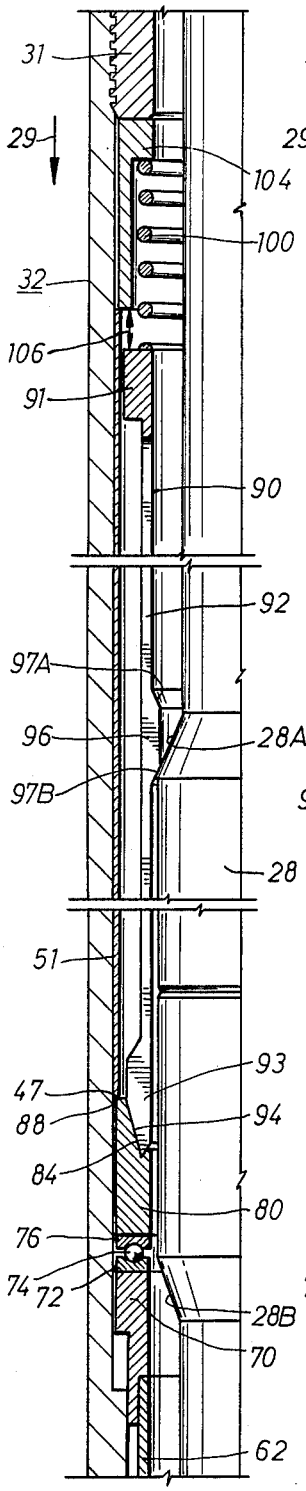
FIGS. 2A through 2D are elevational views, entirely in section, of the first embodiment of the overshot cutter shown in FIG. 1 illustrating the reactions thereof to an obstruction as the overshot is moved in an axially downstring direction.
Figure 2B:
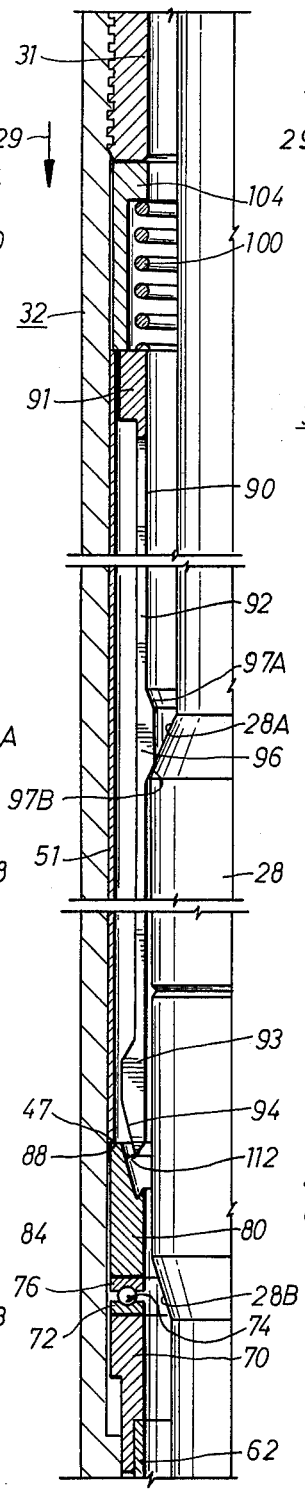
Figure 2C:
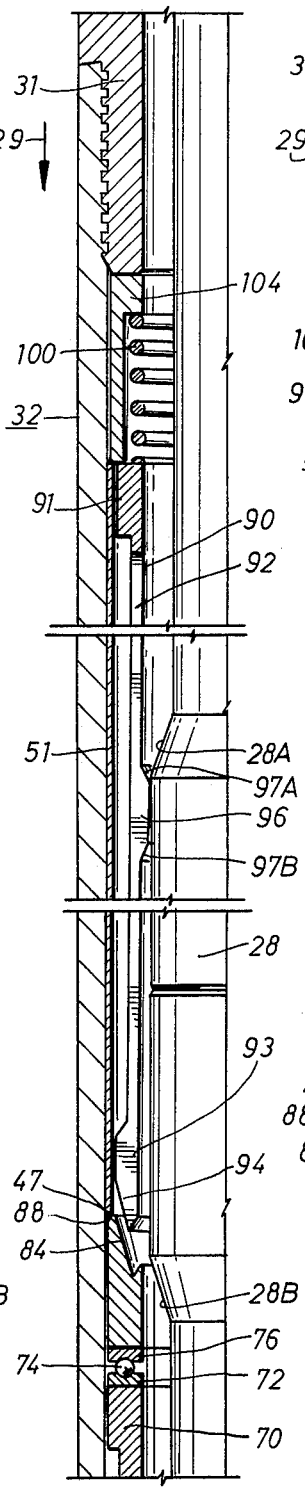

As viewed in FIG. 2A, as the axially lower surface 97B of the gripping elements 96 is engaged by the axially upper surface 28A of the collar 28, axially downhole movement of the overshot 10 is obstructed. However, with continued axial movement of the barrel 32 in the downhole direction 29, the cage seat 80 (through the engagement with the shoulder 47) is moved in the downhole direction against the bias of the spring 100. As the surfaces 84 and 94 are thus axially spaced apart (FIG. 2B) the spring 100 is foreshortened, as indicated by the closing of the distance 106. The compression of the spring 100 stores energy to assist in reestablishing the abutment of the surfaces 84 and 94, as in explained herein. The spacing of surfaces 84 and 94 provides a substantially radial clearance 112 (FIG. 2B) which permits the fingers 92 to cantilever radially outwardly. This cantilevered movement permits the gripping elements 96 to move radially outwardly (compare FIGS. 2B and 2C) to permit the gripping elements 96 to move to the second, outer position (FIG. 2C) and to clear the collar 28 and the surface 28A thereon. Note that the axial separation of the surfaces 84 and 94 is directly related to the magnitude of the axial clearance 106.

Figure 2D:
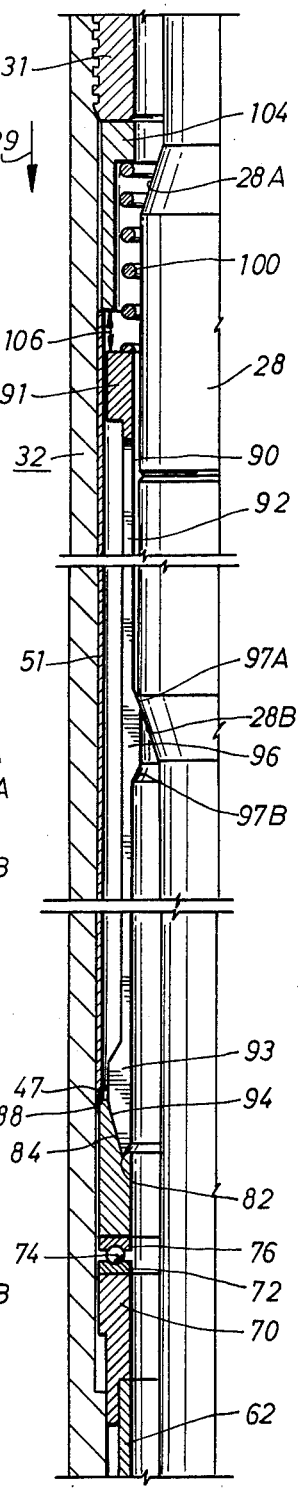

As seen in FIG. 2D, once axially past the collar 28, the force of the spring 100 becomes dominant and the surfaces 84 and 94 are again urged into abutting contact. The clearance 106 is reestablished and the overshot 10 continues in the axially downhole direction 29 in the annular region 12.

In this manner it may be appreciated that an overshot 10 embodying the teachings of this invention permits the gripping elements 96 to move from the first, radially inner position, to the second, radially outer, position as the engaged abutment surfaces 84 and 94 are axially spaced apart. Thus, the obstructions to downhole advancement offered by the collars 28 may be expeditiously overcome.

Figure 3A:
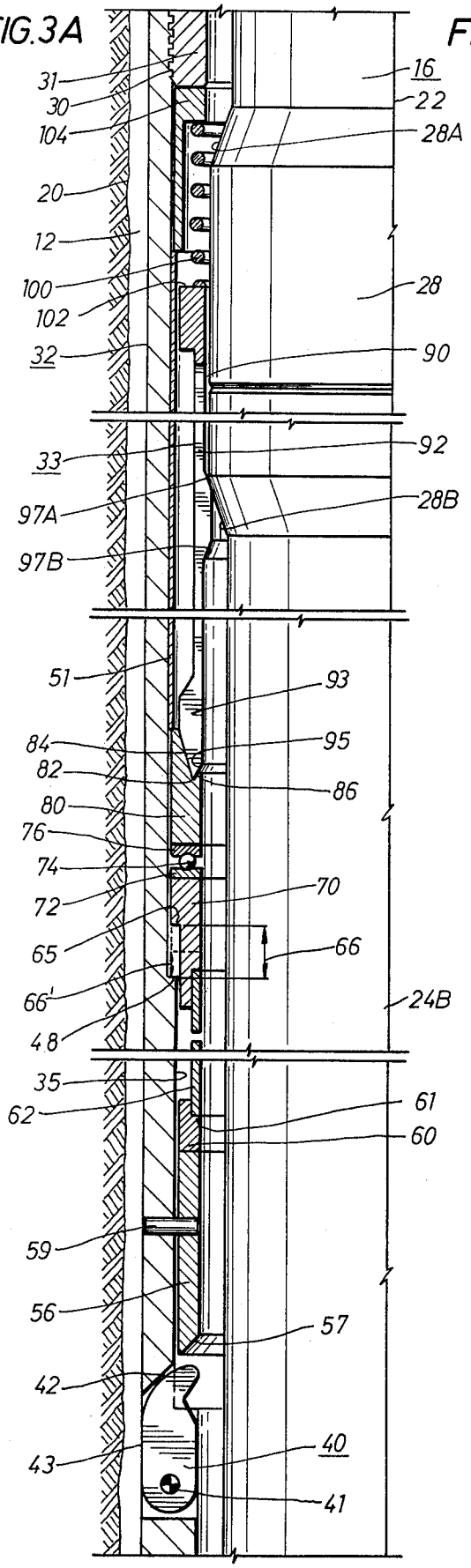
FIGS. 3A and 3B are elevational views, entirely in section, of the first embodiment of the overshot cutter shown in FIG. 1 illustrating the reactions thereof to an obstruction as the cutting elements are extended.
Figure 3B:
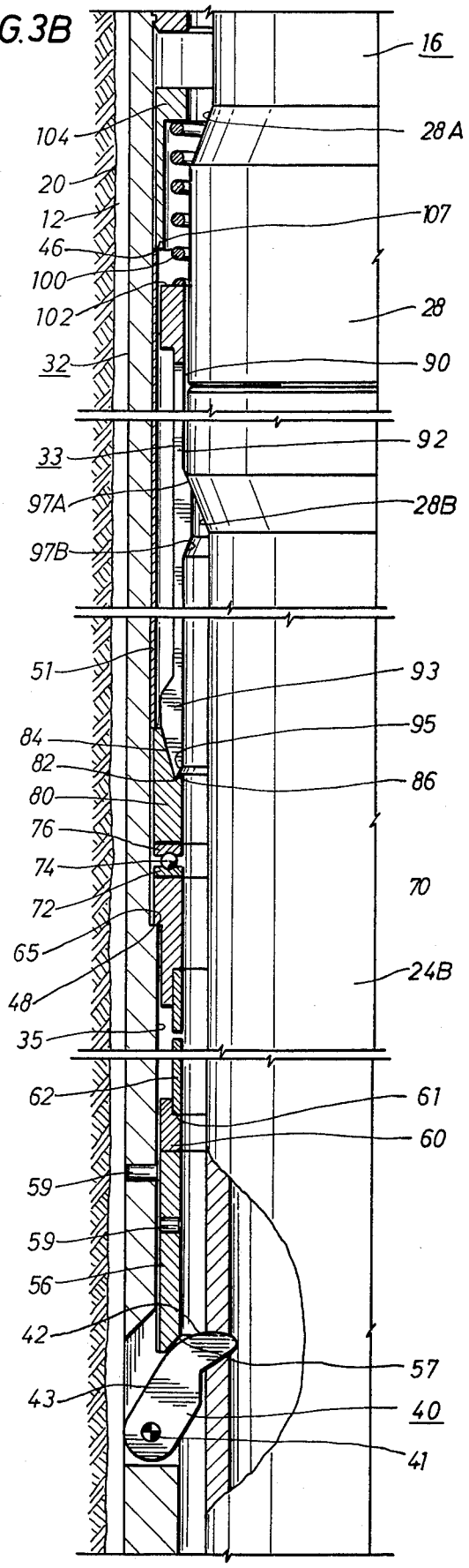

When it has been ascertained that the cutting elements 40 are substantially axially adjacent to the point on the drill string at which it is desired to sever the string, the overshot 10 is ready for actuation and inward extension of the cutting elements 40. Since at the desired severance point the gripping elements 96 may be slightly below the next adjacent upstring surface 28B of the collar 28 (FIG. 3A), a slight upstring strain of the overshot 10 brings the upper surface 97A of the gripping elements 96 into engagement with the downstring axial surface 28B of the collar 28. As shown in FIG. 3A, in this position it may be appreciated that the upstring force partially closes the clearance 66 (as indicated in dot-dash lines) to the distance 66' to fully compress the power spring 62. The upstring force is transmitted through the shear pin 59 and through the elements of the inner member 33 to brace the gripping elements 96 firmly against the lower surface 28B of the collar 26. The tip 95 of the fingers 92 are received in the notch 82 in the cage seat 80 so that slippage of the flexible cage is prevented. In the position of FIG. 3A, it is seen that the gripping elements 96 (through the abutment of surfaces 97A and 28B) In effect provides a brace to maintain the inner member 33 in a substantially stationary position with respect to the outer member 32. With the elements in the position shown in FIG. 3A, an axially upstring strain on the barrel 32 causes the shear pin to be severed by the force of the spring 62 and the clearance 65 fully closes (FIG. 3B).

Severance of the shear pin brings the lower surface 57 of the sleeve member 56 into engagement with the sloped surface 42 on the cutting elements 40. The stored energy of the spring 62 urges the cutting elements 40 inwardly. The cutting elements 40 are pivoted on the pin 41 radially inwardly to contact the exterior surface of the drill string. With the contact between the cutting elements 40 and the drill string established, the outer barrel is then imparted a rotational movement causing the cutting elements 40 to bite into and sever that portion of the drill string below the predetermined cutting point. Note that those portions of the inner member 33 below the bearing member 74 rotate with the outer barrel 33, while the remaining elements, including the gripping elements 96, remain stationary relative thereto. Continued rotation of the cutting elements 40, combined with the energy of the spring 62 imparted to the elements 40, cams the cutting elements 40 radially inwardly as the cut progresses. With the cut completed, continued upstring strain on the overshot 10 lifts the severed fish to the surface.

The overshot 10 is retractable in an axially upstring direction. With reference again to FIG. 3A, it may be appreciated that if it is desired to retract the cutter for any reason, lifting of the overshot in an upstring direction causes the gripping elements 96 to be forced radially outwardly (despite the presence of the engaged tip 93 and notch 82) to permit withdrawal of the overshot. Although the magnitude of upwardly directed force necessary to move the overshot in an upstring direction is greater than the magnitude of the force required to sever the shear pin 59, it can nonetheless be appreciated that withdrawal of the overshot may be effected with a loss of only of the cutting elements 40 themselves. These cutting elements can be easily replaced.

Figure 5A:
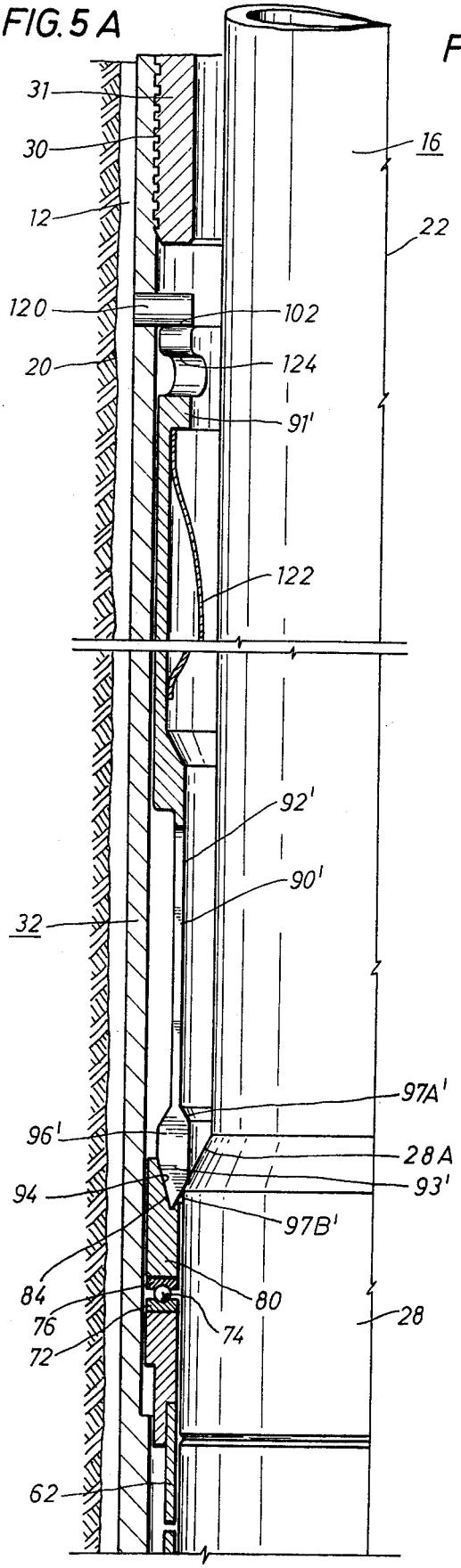
FIGS. 5A through 5C are elevational and developed views, entirely in section, showing a second embodiment of the invention; and, FIGS. 6A through 6C are elevational views, entirely in section, of the second embodiment of the invention shown in FIG. 5 and the reactions thereof in response to an obstruction as the overshot is moved in an axially downstring direction.
Figure 5C:
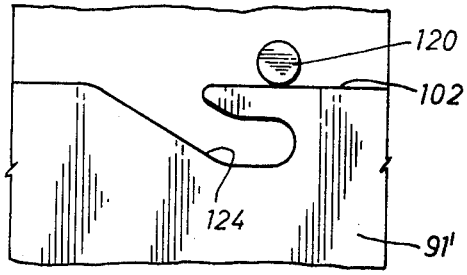
Figure 5B:
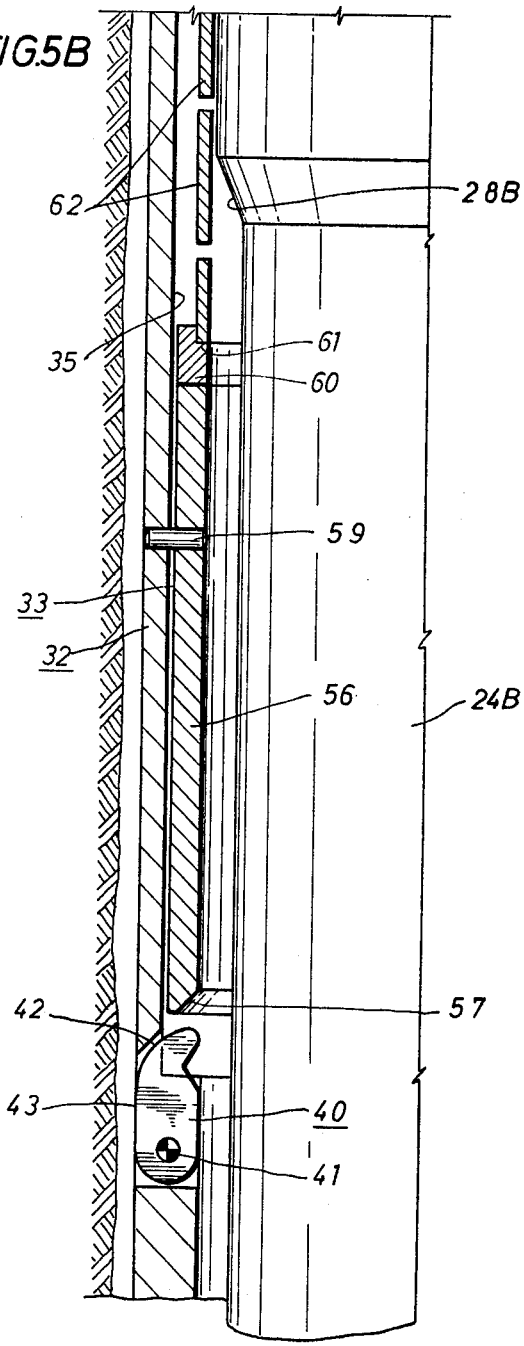

With reference to FIG. 5, a second embodiment of the overshot cutter 10 is shown. FIGS. 5A and 5B are a broken elevation view, entirely in section, of the second embodiment of the overshot cutter 10. FIG. 5C is a developed view of a portion of FIG. 5A. It is noted that the structure of the overshot 10 axially below the flexible cage seat 80 is identical to that described in connection with FIGS. 1 through 3. Therefore, a description in detail of those elements is not repeated.

As seen in FIG. 5A, the flexible cage 90 (FIG. 4) has been modified in accordance with the teachings of this invention. Further, the elements of the inner member 33 formerly disposed in connection with the first embodiment above the flexible cage 90 (the spring 100 and the spring retainer 104) have been eliminated. The interior of the barrel 32 has been slightly modified also in that the shoulders 46 and 47 (whether provided by internal machining or by the sleeve 51) have also been eliminated.

As seen in FIG. 5A the barrel 32 has a radially inwardly extending dowel 120. The flexible cage 90' has also been modified slightly. From FIG. 5A it may be seen that the fingers 92' extend for an axially length slightly less than one-half the cage 90'. Further, it may be appreciated that the gripping elements 96' having upper and lower surfaces 97A' and 97B' respectively, have been relocated adjacent the axially lower tip 93'. Further, the axially upper, remaining portion of the cage 90' has provided on the interior surface thereof a plurality of friction springs 122. The collar 91' of the cage 90' is provided with a groove 124, best seen in the developed view thereof shown in FIG. 5C.

In view of the foregoing, it may be appreciated that as the overshot 10 is moved in an axially downstream direction, the dowel 120 abuts against the top lip 102 of the cage 90'. The surfaces 94 and 84 on the fingers 92' and the cage seat 80, respectively, are therefore maintained in abutting relationship. The gripping elements 96', however, are engageable by the distended collar portions 28 of the drill pipe and, as illustrated in FIG. 5A, obstruct continued downward movement of the overshot. It is noted that although the spring elements 122 contact the exterior of the drill pipe, they are flexible and resilient and do not offer resistance to continued axial movement of the overshot even when the springs 122 are in the vicinity of the distended collar portion 28.

With the obstructing contact between the gripping means 96' and the axially upper surface 28A of the collar 28 (as illustrated in FIG. 5A) it may be appreciated that continued axially advancement of the overshot is obstructed. However, axially separating and spacing apart the engaged surfaces 84 and 94 will, in a manner similar to that discussed above, provide a sufficient radial clearance to permit the gripping means 96' to move radially from the first, inner, position (in which they are engageable by the distension on the drill pipe) to a second, radially outer, position in which they may pass axially over that distension. In order to space the surfaces axially apart, this embodiment of the invention requires that the dowel 120 be disposed within the groove 124. Insertion of the dowel 120 within the groove may be accomplished by a combination of axially and rotational movement of the outer barrel 32 with respect to the flexible cage portion 90' of the inner member 33. The provision of the gripping springs 122 and their frictional contact with the exterior of the drill pipe permits the flexible cage portion 90' to remain relatively stationary with respect to the rotating outer barrel 32 to permit the dowel to be inserted into the groove 124.

Figure 6A:
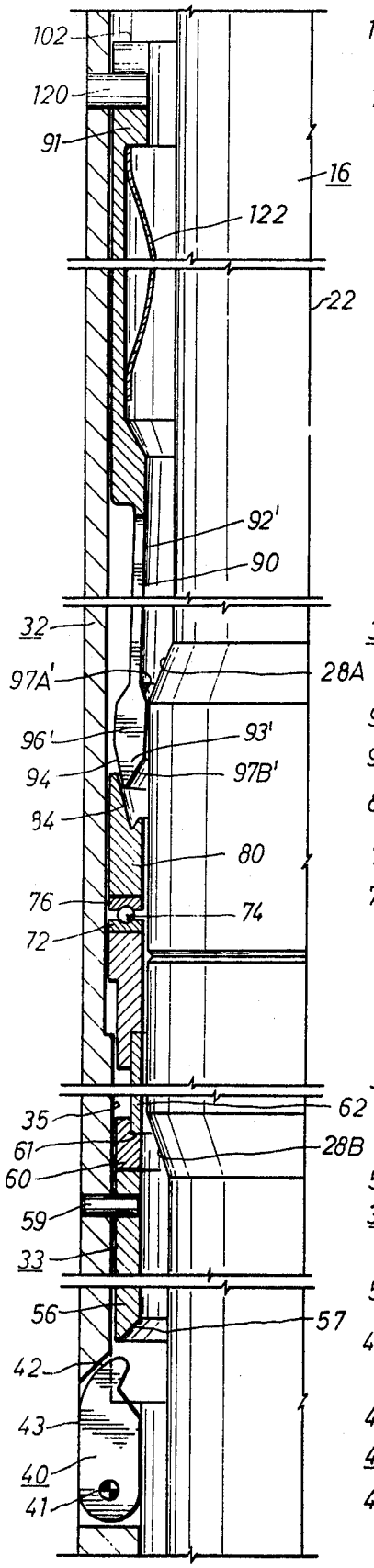

Thus, it may be understood, as shown in FIG. 6A, that with the dowel 120 received within the groove 124, the surfaces 84 and 94 are spaced axially apart and sufficient radial clearance is provided to permit the gripping elements 96' to move to the second, radially outer position, where they may pass axially over the distended portion 28 of the drill pipe.

Figure 6B:
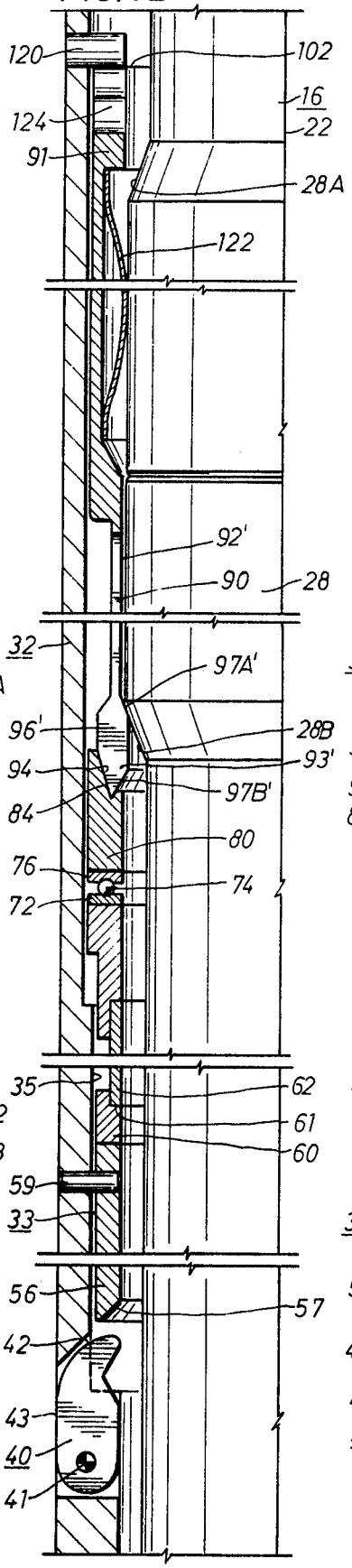
Figure 6C:
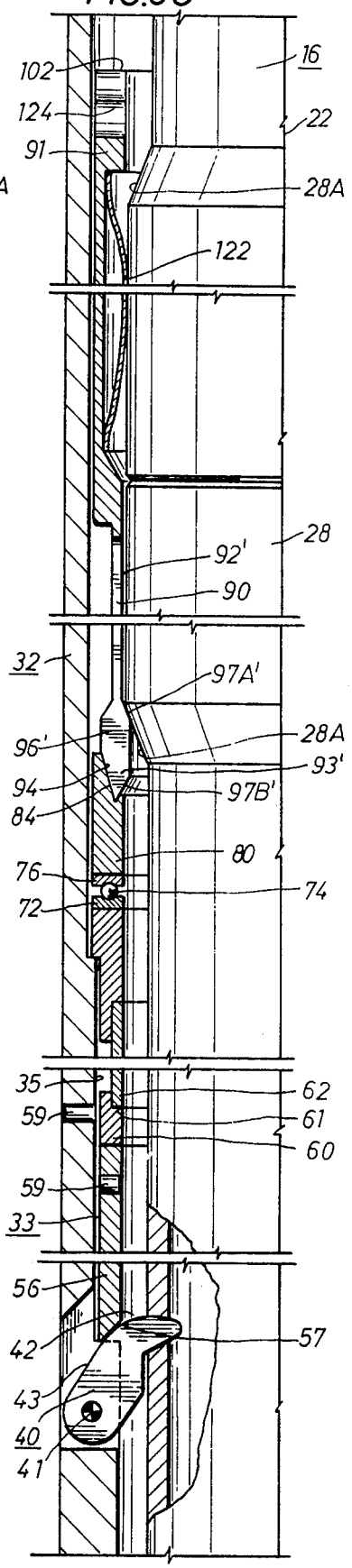

Further, as seen in FIG. 6B, in order to extend the cutting elements 40, it is necessary to back the dowel 120 out of the groove 124 and provide an upward strain on the outer barrel 32 so as to lock the grouping elements 96' (and more particularly the surface 97A' thereof) into abutting contact with the lower axial surface 28B of the collar 28. Similar to the reactions described in connection with FIG. 3, the cutters 40 are extended into engaging contact with the drill pipe. It may be appreciated that any time that it is desired to retract the overshot from the annulus 12, it is simply necessary to reengage the dowel 120 with the groove 124. The engagement of the dowel 120 with the groove 124 has the effect of axially spacing apart the abutment surfaces 84 and 94 to provide sufficient radial clearance to permit the gripping elements to move radially to clear the distended portions of the drill pipe. Of course, in practice, it may be desirable to engage the dowel 120 into the J-groove 124 prior to insertion into the bore.

In summary, it may be appreciated that an overshot cutter provided with a flexible release cage according to this invention is operable to permit expeditious insertion and retraction of an overshot cutter from within a bore.

It is understood that although preferred embodiments of the invention have been discussed, other arrangements may be provided by those with skill in the art in view of the teachings herein presented, yet remain within the contemplation of this invention as set forth in the appended claims.

What is claimed is:

1. Apparatus for severing a drill string from the exterior thereof, comprising:

a flexible inner member having a first abutment surface thereon;

an outer member concentrically disposed about said inner member, said outer member having a second abutment surface thereon sized to receive said first abutment surface;

means for gripping a distended portion of a drill string disposed radially inwardly of said inner member, said gripping means being mounted on said flexible inner member for radial movement from a first, inner, position in which said gripping means is engageable by the distended portion of the drill string to obstruct axial movement of said overshot cutter with respect thereto to a second, radially outer, position in which said gripping means is axially movable with respect to the drill string;

said first and said second abutment surfaces being engagable to maintain said gripping means in said first, inner, position, said outer member being axially movable relative to said flexible inner member to disengage and axially space apart said abutment surfaces and to define a radial clearance therebetween sufficient to permit said inner member to flex radially outwardly and to move said gripping means from said first, inner, to said second, radially outer, position.

2. Apparatus according to claim 1 wherein said flexible inner member has a groove therein, and said outer member has an inwardly extending dowel thereon, said groove and said dowel being disposed such that rotational movement of said outer member with respect to said inner member disposes said dowel within said groove to disengage and axially space apart said first and said second abutment surfaces.

3. Apparatus according to claim 1 further comprising means for biasing said first abutment surface into abutting contact with said second abutment surface so that as said gripping means is obstructed by the distended portions of the drill string continued axial movement of said outer member with respect to the inner member foreshortens said biasing means as said first and said second abutment surfaces are spaced apart.

4. Apparatus according to claim 3 wherein said first and said second abutment surfaces are inclined axially downwardly and radially inwardly relative to said outer member.

5. Apparatus according to claim 3 wherein said flexible inner member comprises an annular collar having a plurality of axially extending, circumferentially spaced fingers extending therefrom.

6. Apparatus according to claim 3 wherein said biasing means comprises a spring element.

7. Apparatus according to claim 2 wherein said first and said second abutment surfaces are inclined axially downwardly and radially inwardly relative to said outer member.

* * * * *